United States Patent [19]

High et al.

[11] 3,934,792

[45] Jan. 27, 1976

[54] CENTRIFUGE APPARATUS

[75] Inventors: Robert Edward High, St. Ives; Albert John Samways, Winston Hills, both of Australia

[73] Assignee: Pennwalt Corporation, Philadelphia, Pa.

[22] Filed: Jan. 3, 1975

[21] Appl. No.: 538,492

[52] U.S. Cl. ..... 233/7

[51] Int. Cl.[2] ..... B04B 3/04

[58] Field of Search..... 233/7, 14 R, 14 A, 1 D, 233/1 R, 27, 28

[56] References Cited

UNITED STATES PATENTS

| | | | |
|---|---|---|---|
| 2,600,372 | 6/1952 | Milliken et al. | 233/7 |
| 3,368,747 | 2/1968 | Lavanchy et al. | 233/7 |
| 3,405,866 | 10/1968 | Amero | 233/7 X |

FOREIGN PATENTS OR APPLICATIONS

| | | | |
|---|---|---|---|
| 1,007,700 | 5/1957 | Germany | 233/7 |

*Primary Examiner*—George H. Krizmanich
*Attorney, Agent, or Firm*—Edward A. Sager

[57] ABSTRACT

A decanter centrifuge has a screw conveyor within an imperforate bowl defining a helical chamber. The conveyor is provided with a baffle extending in generally axial direction between the screw flights, thereby dividing the helical chamber within the bowl into a separating zone and a heavy phase discharging zone. The outer portion of the baffle defines with the bowl a restricted passageway which permits the underflow of separated heavy phase material from the separating zone to the heavy phase discharging zone. Pressurizing means, preferably means for maintaining the inner surface of the separated light phase layer inwardly of the weir surface of the heavy phase discharge port, helps advance the separated heavy phase material through the restricted passageway and toward the port through which heavy phase material is discharged.

15 Claims, 9 Drawing Figures

CENTRIFUGE APPARATUS

BACKGROUND OF THE INVENTION

U.S. Pat. No. 3,795,361, was granted Mar. 5, 1974 in the name of C. Y. Lee to the assignee of the present invention. The background of that invention is applicable to the present invention, and it is therefore incorporated herein by reference.

It is advantageous to provide a baffle within the centrifuge bowl; which baffle, in use, extends through the inner layer of separated light phase material and into the outer layer of separated heavy phase material. Preferably, the outer edge or portion of such baffle defines with surrounding structure, e.g. the inner surface of the bowl, a restricted passageway for the underflow of heavy phase material from the separating zone on one side of the baffle to the discharging zone for heavy phase material on the other side of the baffle. With this arrangement, heavy phase material such as flowable solids may be discharged containing a controlled or reduced amount of light phase material. For example, solids may be discharged in dryer condition than was possible prior to the invention of the cited patent.

Means are provided to pressurize the heavy phase material and thereby promote its advance through the restricted passageway toward its discharge port in the tapered end of the bowl, such advance also being aided by the screw conveyor. The most convenient form of pressurizing means is the provision of light phase discharge ports having weir surfaces disposed closer to the rotational axis of the bowl than are the weir surfaces of the heavy phase discharge ports, thereby cooperating with the baffle to maintain a deep layer of liquid or other separated light phase material in the separating zone. The extra pressure head provided by a deep layer of light phase material provides the desired added pressure on the heavy phase layer. A centripetal pump may also be employed to control the rate of light phase discharge from the bowl and, thus, also control the level of the light phase layer remaining in the bowl.

The present invention is directed to accomplishing the same or a similar result as with the construction of the cited patent, but by means of a smaller and more simply constructed and installed baffle. It is an object of the present invention to provide an economical but effective baffle for the purpose described.

Figure 5:
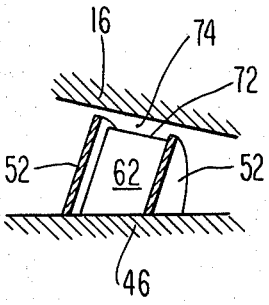
FIG. 5 is a view of a fragment of FIG. 1.
Figure 6:
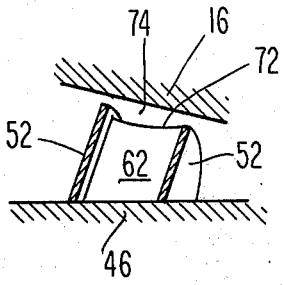
Figure 7:
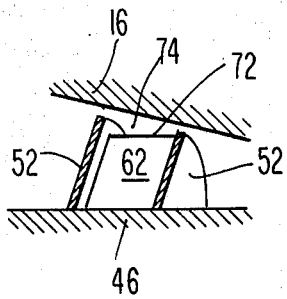
Figure 8:
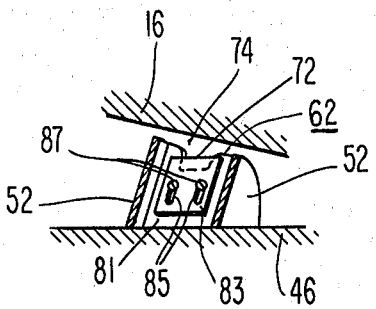

Each of FIGS. 6, 7 and 8 is a view similar to FIG. 5 showing a further modification of the invention.

Figure 9:
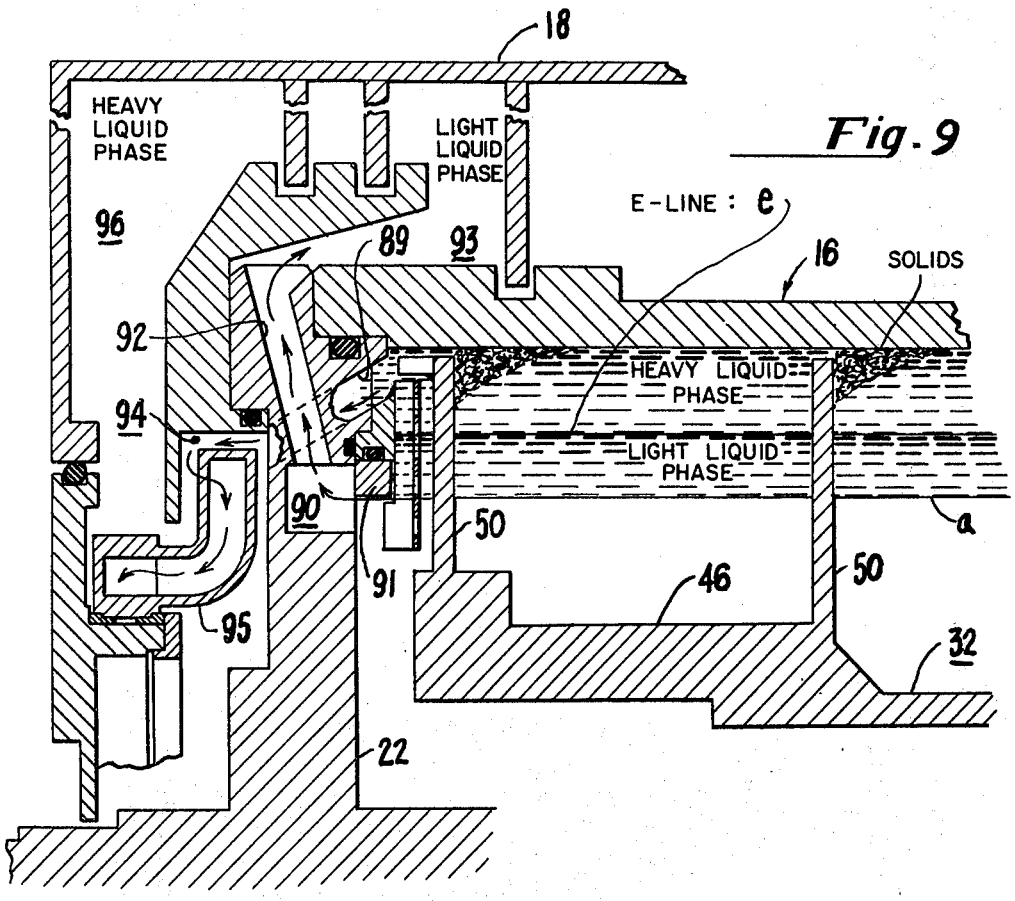

FIG. 9 shows the liquid discharge end of a centrifuge which has been modified for three phase separation in accordance with U.S. Pat. No. 3,623,656.

DESCRIPTION OF THE PREFERRED EMBODIMENTS

Figure 1:
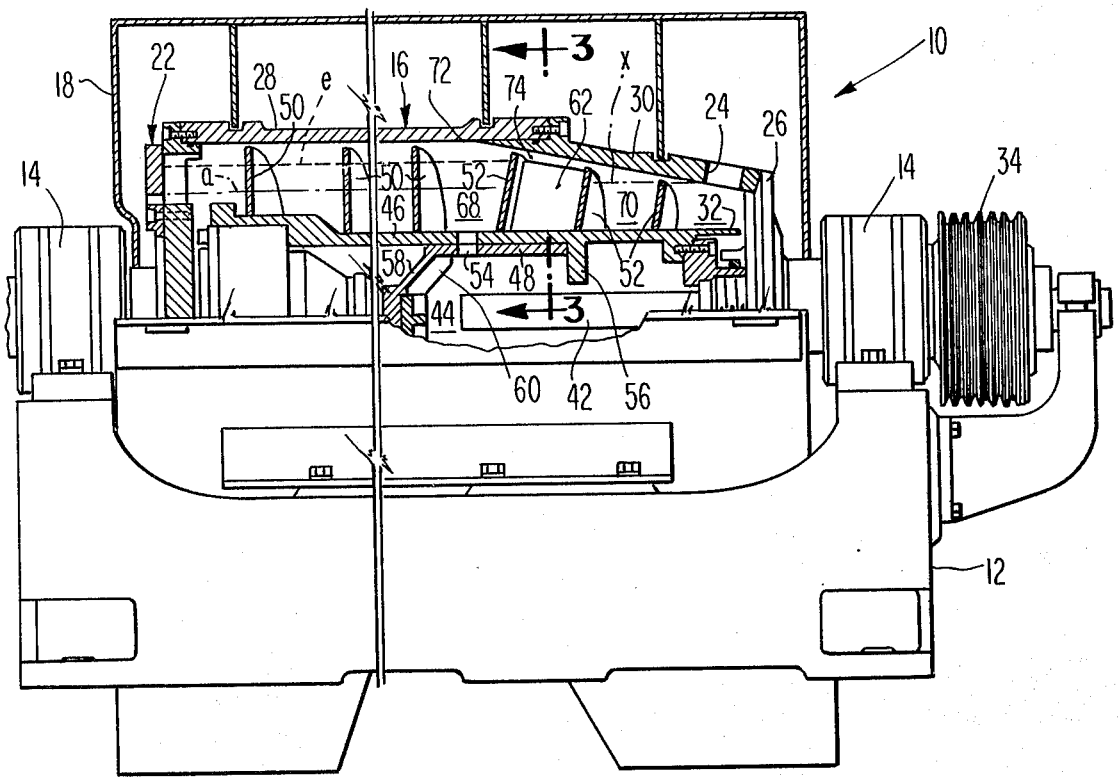
FIG. 1 is an elevational view, partly in section, of a centrifuge embodying one form of the invention.

Shown in FIG. 1 is a centrifuge 10 comprising a frame 12 having main bearings 14 in which are journaled the ends of a hollow, elongated centrifuge bowl 16 of circular cross section. The bowl 16 is adapted for rotation about its longitudinal axis within a housing 18. A plurality of discharge ports or openings 20 are formed in one end wall 22 of the bowl 16 and annularly disposed about the rotational axis for the discharge of liquid or light phase material. A plurality of similarly disposed solids or heavy phase discharge ports or openings 24 are provided adjacent the other end wall 26.

In other respects the peripheral wall of the bowl 16 is of imperforate tubular construction, a major portion 28 thereof being cylindrical.

The end portion 30 of the bowl 16 adjacent the end wall 26 is tapered or convergent, its inner surface gradually decreasing in diameter towards and beyond the solid discharge openings 24. The liquid discharge openings 20 and the heavy phase discharge ports or openings 24 are at selectively adjustable radial distances from the rotational axis, preferably so that during proper operation the inner surface of the light phase material will be disposed radially inward of the weir surfaces of the heavy phase discharge ports 24.

Mounted coaxially of the bowl 16, in suitable bearings adjacent the ends of the bowl 16, is a screw conveyor 32. The bowl 16 is rotated by connection through a pulley 34 to suitable drive means, such as a motor (not shown). In order to rotate the bowl 16 and the conveyor 32 at slightly different speeds, the rotation of the bowl 16 is transmitted to a gear box having torque control means and thence through a spline shaft within the bowl shaft to the conveyor 32, as shown in the cited U.S. Pat. No. 3,795.361, or by other well known means.

The process feed stream, or mixture to be separated, is delivered to the interior of the centrifuge through a stationary feed tube 42. The latter projects in axial direction and terminates concentrically of a feed chamber 44 partly defined by the interior of a hub 46 having an internal lining 48.

The hub 46, which is part of the conveyor 32, carries outwardly projecting, cylindrically coiled screw flights 50, and also outwardly projecting, conically coiled screw flights 52. The flights 50 and 52 are mounted in axial series on the hub 46, with small clearance from the bowl 16, for rotation with the hub 46 relative to the bowl 16, preferably at a speed suitably different from the speed of the bowl to move settled solids toward the discharge openings 24 for discharge therethrough. The hub 46 is further provided with one or more feed passages 54 which also extend through the lining 48 in order to discharge the feed outwardly from the feed chamber 44 for separation within the bowl 16.

The feed chamber 44 within the hub 46 extends in axial direction from a partition 56 to an accelerator 58. The latter comprises a cup-shaped plate secured in sealing relationship with the inner surface of the hub 56 and having a vane assembly 60 secured thereto for imparting radial and tangential velocity to the feed mixture delivered thereto by the pipe 42. As shown, the feed pipe 42 lies concentrically within the feed chamber 44.

An annular seal (not shown) may be secured to the partition 56 to close the space between the outer surface of the feed pipe 42 and the portion 56.

A broken line *a* designates the maximum and desired level of materials within the cylindrical portion 28 of the bowl 16 which is maintained by the discharge ports 20. The outermost portion of the surface defining each port 20 acts as a weir over which light phase material flows when discharged from the bowl 16.

The screw conveyor 32 defines with the bowl 16 a helical chamber extending about the axis of the bowl between the discharge ports 20 and the discharge openings 24, such chamber being bounded by the outer surfaces of the hub 46 and the screw flights 50, 52 and the inner surface of the bowl 16.

The coiled screw flights 50, 52 are welded to the outer surface of the hub 46, it being understood that the flights 50 are disposed within the cylindrical portion 28 of the bowl 16 and the flights 52 are disposed within the tapered portion 30 of the bowl 16. A "flight" is considered to be one helical turn or a single coil of the conveyor 32.

The screw conveyor 32, more particularly the outer surfaces of the screw flights 50, 52 and of the hub 46, defines with the inner surface of the bowl 16 a helical chamber extending about the longitudinal axis of the bowl between the discharge ports 20 and the discharge ports 24.

According to the invention, a baffle 62, in the form of a flat plate, is positioned within the bowl 16 to divide or partition the helical chamber into two axially adjacent zones: a first or separating zone 68 and a second or discharging zone 70. The first zone 68 lies between the hub 46 and the cylindrical portion 28 of the bowl 16, while the second zone 70 is disposed between the hub 46 and the tapered portion 30 of the bowl 16. The first zone 68 extends in axial direction from one broad surface of the baffle 62 to the liquid discharge port 20 and end wall 22; the second or discharging zone 70 extends in axial direction from the other broad surface of the baffle 62 to the end wall 26, although for all practical purposes the second zone 70 terminates at the discharge ports 24. The ports 24 communicate with the second zone 70. The ports 20 communicate with the first zone 68.

Preparatory to further description of the baffle 62, it is to be understood that feed entering the separating zone 68 within the rapidly rotating bowl 16 is subjected to high centrifugal forces which are usually 2,000 to 4,000 times gravitational force. This separates the mixture of light and heavy phase materials in zone 68 into an inner annular layer of light phase material and an outer layer of heavy phase material. The annular interface between the two layers in zone 68 is shown by a broken line designated *e*. The layer of heavy phase material lies outwardly of the *e* line; and the layer of light phase material lies inwardly of the *e* line. The inner surface of the light phase layer is approximately in axial alignment with the outermost or weir surface portion of the structure surrounding each port 20, with some allowance for cresting of the liquid discharging from the ports 20.

The *e* line is adjustable by adjusting the level of the ports 20. This is commonly done by providing an end wall 22 having the ports 20 in the desired location. This adjustment is usually suited to the specific gravities of the materials comprising the feed mixture, the percentage of each in the feed, the inflow rate of the feed, and various other factors. In any event, the *e* line may be established by known procedures.

The baffle 62 includes an outer edge 72 which should be carefully positioned relative to the inner surface of the bowl 16 and the *e* line.

Firstly, the baffle 62 must extend outwardly beyond the inner layer of light phase material, i.e., the *e* line, in order to prevent the flow of light phase material from the first zone 68 to the second zone 70. It is better practice to have the outer edge 72 disposed outwardly of the *e* line a substantial distance in order to ensure that some light phase material will not be entrained by heavy phase material flowing from the first zone 68 to the second zone 70. It can also be seen that the baffle 62 must be imperforate at least for the radial distance it contacts the light phase layer, to prevent flow of light phase material into the second zone 70.

Secondly, the outer edge 72 is positioned inwardly of the bowl 16 to define a restricted passageway 74 between them for the underflow of heavy phase material therethrough from the first zone 68 to the second zone 70. The spacing between the outer edge 72 and the bowl 16 determines the flow area of the passageway 74; it should be large enough to prevent an excessive accumulation of heavy phase material in the separating zone 68, that is, at least large enough to permit passage of the heavy phase material in the feed at the rate the heavy phase material is separated in the separating zone.

The outer edge 72 of the baffle 62 must always extend in radial direction, relative to the axis, at least to the weir surface of the discharge port 24 for heavy phase material.

The centrifugal force applied to the light and heavy phase materials in the separating zone 68 produces a centrifugal pressure head which is transmitted to the heavy phase material in the discharging zone 70. This pressure head, when combined with the pressure applied by the screw conveyor 32, overcomes the oppositely directed centrifugal head of the heavy phase material in zone 70. The level of the heavy phase material in zone 70 is shown by a broken line identified by the letter *x*. The level designated *x* is slightly inwardly of the weir surfaces of the discharge ports 24, whereby heavy phase material is discharged from ports 24.

The light phase material has a lower specific gravity than the heavy phase material; and therefore a layer of light phase material which is thicker than a layer of heavy phase material is required to provide an equivalent centrifugal pressure head. Consequently, level *x* is more distant from the rotational axis, in radial direction, than is level *a*. An advantage of a so-called deep pond of all materials in the separating zone 68, which the baffle 62 permits, is that larger volumes of feed are accommodated therein, and therefore greater throughput capacities are obtainable. Furthermore, with a deep pond in the separating zone 68 greater centrifugal forces are imposed upon sedimented solids therein, resulting in better solids compaction. The more compact the solids are in the separating zone 68, the clearer will be the separated light phase material. For example, when separating oil from water and sludge, this improves compaction of the sludge and leads to discharged sludge with lower oil content. Compact solids also lend themselves to more effective conveying by the screw conveyor 32.

The baffle 62 is disposed between the discharge ports 24 for heavy phase material and the path traveled by feed entering the separating zone 68. This keeps the feed out of the discharging zone 70. Feed is introduced through the feed tube 42, the feed chamber 44, and the feed passages 54 into the separating zone 68, it being preferred that the feed passages 54 be axially positioned between the baffle 62 and the liquid discharge ports 20. Feed travels outwardly and joins the separated materials in the separating zone 68 where it undergoes separation.

Figure 2:
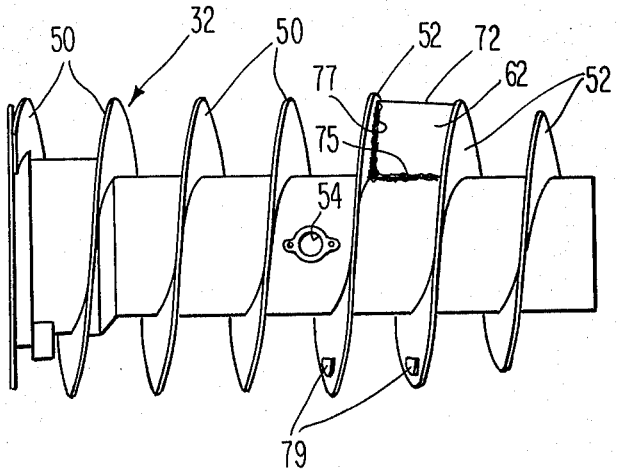
FIG. 2 is an elevational view of a portion of the centrifuge shown in FIG. 1.

The baffle 62 is carried by the screw conveyor 32 and it is constructed to form an integral part thereof. In the embodiment of the invention shown in FIGS. 1 and 2, the baffle 62 extends in generally axial direction between two adjacent screw flights 52 neighboring the separating zone 68. The baffle 62 is preferably a flat plate disposed between the bowl 16 and one side of the hub 46, with its inner edge 75 welded to the hub 46. The baffle 62 also includes a pair of side edges 77 welded to respective ones of the two adjacent screw flights 52, with the weld being continuous along the edges 75 and 77, to provide an effective seal against the flow of liquid material past the edges 75 and 77. The orientation of the baffle 62 is substantially normal to the inner surface of the bowl 16, with the two broad surfaces of the baffle 62 being disposed nearly parallel to a plane extending radially through the longitudinal axis of the bowl. The baffle extends inwardly from its outer edge 72 for the radial distance of the combined thickness of the layers of light phase material and heavy phase material in the separating zone 68, thus preventing the flow of light phase material from the separating zone 68 to the discharging zone 70.

One or more counterweights 79 are secured, as by welding, to the screw flights 52 in order to maintain the screw conveyor 32 in proper balance, it being understood that other well known measures may be employed for this purpose.

The baffle construction just described is more convenient, less expensive and simpler to install than those of the prior art performing the same function; and it is believed to be at least as effective.

Figure 3:
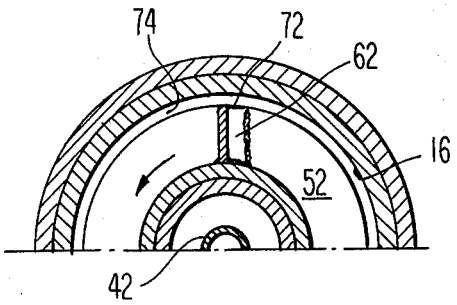
FIG. 3 is a sectional view taken along line 3—3 of FIG. 1 and looking in the direction of the arrows.

In FIG. 3 it can be seen that the baffle 62 is not precisely disposed with its broad surfaces parallel to a plane passing through the longitudinal axis, but nearly so. This is because it is preferred that the baffle 62 be welded to adjacent screw flights 52 so as to be disposed normal to the mutually facing surfaces of the adjacent screw flights. From the portion shown in cross-section in FIG. 3, it will be noted that the radial extent of the baffle 62 is radial to the axis. The screw conveyor 32 turns in the direction of the arrow relative to the bowl 16.

MODIFICATION

Figure 4:
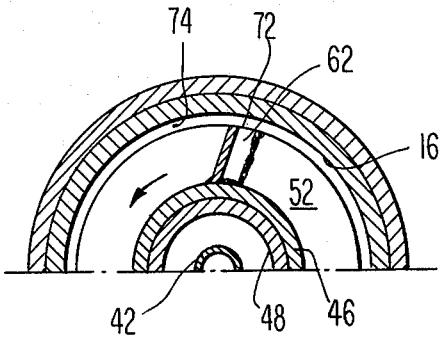
FIG. 4 is a view similar to FIG. 3, but showing the invention in modified form.

The modification of the invention shown in FIG. 4 employs the same reference numerals used in FIG. 3, because the parts are functionally similar. Again, the baffle 62 is arranged in normal relationship to the mutually facing surfaces of the adjacent screw flights 52. However, the portion of the baffle 62 shown in cross-section can be seen to be non-radial to the axis, that is, at an angle to the bowl which is less than a right angle on the side of the baffle 62 leading its rotation relative to the bowl 16.

Further modifications appearing in FIGS. 6, 7 and 8 may be compared with FIG. 5, since FIG. 5 is a fragmentary view of FIG. 1. In FIG. 5, the outer edge 72 is parallel to the neighboring portion of the inner surface of the bowl 16, whereas in the arrangements of FIGS. 6, 7 and 8 the outer edge 72 and the surface of the bowl 16 are non-parallel, that is, the outer edge is at varying distances from the bowl 16.

In FIG. 6 the outer edge 72 is curvilinear. In the preferred arrangement of FIG. 7, the outer edge 72 is straight and parallel to the inner surface of the cylindrical portion 28 of the bowl 16, with the space between the outer edge 72 and the adjacent bowl surface being tapered.

In FIG. 8, the baffle 62 is adjustable, since it comprises a fixed portion 81 and a movable portion 83, with the outer edge 72 being on the movable portion 83. The movable portion 83 is adjustably secured to the fixed portion 81 by means of a pair of radial slots 85 in the movable portion and corresponding locking screws 87 which pass through the slots 85 to secure the movable portion 83 to the fixed portion 81 in desired position. By this arrangement, the degree of restriction afforded by the passageway 74 may be adjusted by selectively adjusting the movable portion of the baffle 62 to desired position and securing the same in place with the screws 87.

The invention has been shown having ports 20 for discharge of the light phase material. These may be provided by any well known means, but it should be understood that the present invention may be practiced by providing a centripetal pump as means for discharging the light phase material. Such pumps are well known in the art, and therefore a description thereof will be omitted for the sake of brevity.

The invention also contemplates the discharge of two phases of light phase material, e.g. two liquids of different specific gravity. While it is possible to discharge two liquids of different specific gravity by means of a centripetal pump or a pair of centripetal pumps having inlets at different levels, the invention may be practiced by providing means for discharging light phase material having provision for separate discharge of two liquids of different specific gravity. A means of accomplishing this is more fully disclosed in U.S. Pat. No. 3,623,656, which was granted on Nov. 30, 1971 in the name of A. C. Lavanchy to the assignee of the present invention. The disclosure of the construction of the cited Lavanchy patent is incorporated herein by reference.

In a three-phase centrifuge having a liquid discharge end modified according to FIG. 9, a first group of liquid discharge openings 89 in the end wall 22 is symmetrically disposed with respect to the axis of rotation, being positioned adjacent to the inner annular face of the bowl 16. A second group of liquid discharge openings 90 in the end wall 22 is symmetrically disposed with respect to the axis of rotation, with the weir surfaces of the discharge openings 90 being at a smaller radial distance from the axis of rotation than the weir surfaces of the openings 89. During rotation of the bowl 16, the two liquid phases separate into two concentric pools, with heavy phase liquid discharging through the openings 89, while the light phase liquid is discharging through the openings 90. A ring dam 91 provides at each opening 90 a weir surface for light phase liquid which is discharged via openings 90 and passageways 92 into an annular zone 93. Heavy phase liquid is discharged through openings 89 into an annular channel 94 and thence by a skimmer tube 95 into an annular zone 96. For additional details, reference is again made to U.S. Pat. No. 3,623,656.

OPERATION

The operation of a centrifuge embodying the present invention will not be described at length herein, since it will suffice to refer in general to the aforementioned U.S. Pat. No. 3,795,361 to C. Y. Lee. The present invention differs substantially, however, by providing a restricted passageway 74 having a cross-sectional area bounded by the outer edge 72, the neighboring portion (throughout rotation) of the inner surface of the bowl 16, and the outer ends of the adjacent screw flights 52 to which the baffle 62 is welded. This is to be distinguished from the annular passageway 74 provided in the cited Lee patent, which passageway is disposed between the entire circumferential periphery of the annular baffle and adjacent inner bowl surface. The present invention is believed to have an operational advantage over the Lee device in that it provides a more reliable seal against the escape of light phase material from the separating zone 68 to the discharging zone 70. In other words, by establishing the restricted passageway 74 between adjacent screw flights 52, a rather compact zone, it is believed that better control of what flows through the passageway 74 is afforded by the present invention when compared with controllability of flow for the entire circumference of the annular baffle provided by the Lee device.

A further advantage of the present invention is that it is extremely easy and inexpensive to install, and moreover exceptionally easy to alter at an installation site as compared with an annular baffle.

What is claimed is:

1. In a decanter centrifuge for separating light and heavy phase materials into respective inner and outer layers from a mixture thereof and for separately discharging said materials, having an elongated imperforate bowl with a tapered portion, said bowl being adapted for rotation about its longitudinal axis, feed means for delivering the mixture to be separated into said bowl, a screw conveyor comprising a hub and a series of helical flights mounted on said hub, said series of helical flights being coaxially arranged within the bowl to advance heavy phase material in the direction of the tapered portion of the bowl during rotation of said screw conveyor relative to said bowl, means for discharging light phase material from the bowl, and means for discharging heavy phase material from the bowl including a discharge port in the tapered portion of said bowl, said discharge port having a weir surface, said screw conveyor defining with said bowl a helical chamber extending about said axis between said means for discharging light phase material and said means for discharging heavy phase material, that improvement comprising:

a baffle carried by the screw conveyor and extending between the mutually facing broad surfaces of two adjacent helical flights in sealing relationship to thereby divide the helical chamber into a separating zone communicating with said means for discharging light phase material, and a discharging zone for heavy phase material, said discharging zone being disposed within the tapered portion of the bowl and communicating with said means for discharging heavy phase material, said baffle having an outer edge closely spaced from said bowl to define therewith a restricted passageway for the underflow of heavy phase material from the separating zone to the discharging zone and extending inwardly from said outer edge for at least the radial distance of the combined thickness of said layers of light phase material and heavy phase material in the separating zone to prevent the flow of light phase material from said separating zone to said discharging zone, and means cooperating with said baffle to maintain the inner surface of the layer of separated light phase material at a level disposed inwardly of said weir surface and to discharge light phase material from said separating zone to said discharge passageway, the centrifugal pressure head of the layer of separated light phase material being applied to the heavy phase material in the separating zone and being transmitted through the restricted passageway to the heavy phase material in said discharging zone, whereby the centrifugal pressure head transmitted to the heavy phase material in said discharging zone combines with the force applied by said screw conveyor to the heavy phase material in said discharging zone to overcome the centrifugal pressure head of the heavy phase material in said discharging zone, and thereby advance the heavy phase material in said discharging zone to said discharge port for discharge therefrom.

2. A centrifuge according to claim 1 wherein the baffle is substantially flat.

3. A centrifuge according to claim 2 wherein the baffle has an inner edge sealed to said hub.

4. A centrifuge according to claim 2 wherein at least one broad surface of the baffle is disposed substantially parallel to a plane extending through the longitudinal axis of said bowl.

5. A centrifuge according to claim 1 wherein the broad surfaces of the baffle are disposed substantially normal to the inner surface of said bowl.

6. A centrifuge according to claim 1 wherein the broad surface of the baffle is disposed to the inner surface of said bowl at an angle which is less than a right angle on the side thereof leading its rotation relative said bowl.

7. A centrifuge according to claim 1 wherein the baffle includes a first portion secured to said adjacent helical flights, and a second portion including said outer edge, said second portion being adjustably secured to said first portion for adjustably setting the area of said restricted passageway by adjustably setting the space between said outer edge and said bowl.

8. A centrifuge according to claim 1 wherein the outer edge is substantially equally spaced from the bowl.

9. A centrifuge according to claim 1 wherein the outer edge is at varying distances from the bowl.

10. A centrifuge according to claim 9 wherein the space between the outer edge and said bowl is tapered.

11. A centrifuge according to claim 1 further including a counterweight for the baffle secured to the conveyor.

12. A centrifuge according to claim 1 wherein the means for discharging light phase material is a second discharge port, provided in the end of the bowl opposite the tapered portion.

13. A centrifuge according to claim 12 wherein the second discharge port has a second weir surface disposed closer to said axis than is said first-mentioned weir surface.

14. A centrifuge according to claim 1 wherein the means for discharging light phase material comprises second and third discharge ports, provided in the end of the bowl opposite the tapered portion, with said second discharge port having a second weir surface disposed closer to said axis than is said first-mentioned weir surface, and with said third discharge port having a third weir surface disposed farther from said axis than are said second weir surface and said first-mentioned weir surface, whereby two phases of light phase material may be discharged by said means for discharging light phase material.

15. A centrifuge according to claim 1 wherein said feed means extends along said axis and is provided with an outlet axially positioned between said baffle and the means for discharging light phase material.

* * * * *